US011565308B2

(12) United States Patent
Nieminen et al.

(10) Patent No.: US 11,565,308 B2
(45) Date of Patent: Jan. 31, 2023

(54) CLEANING SAND USED AT FOUNDRY

(71) Applicant: Finn Recycling Oy, Urjala (FI)

(72) Inventors: Jukka Nieminen, Urjala (FI); Timo Kronqvist, Urjala (FI); Toni Wesin, Urjala (FI)

(73) Assignee: FINN RECYCLING OY, Nuutajärvi (FI)

( * ) Notice: Subject to any disclaimer, the term of this patent is extended or adjusted under 35 U.S.C. 154(b) by 126 days.

(21) Appl. No.: 17/032,473

(22) Filed: Sep. 25, 2020

(65) Prior Publication Data

US 2021/0094090 A1 Apr. 1, 2021

(30) Foreign Application Priority Data

Sep. 27, 2019 (EP) ..... 19200156

(51) Int. Cl.

| | |
|---|---|
| ***B22C 5/10*** | (2006.01) |
| ***B22C 5/06*** | (2006.01) |
| ***B22C 5/08*** | (2006.01) |
| ***B22C 5/18*** | (2006.01) |

(52) U.S. Cl.

CPC ..... *B22C 5/10* (2013.01); *B22C 5/06* (2013.01); *B22C 5/08* (2013.01); *B22C 5/185* (2013.01)

(58) Field of Classification Search

CPC .... B22C 5/10; B22C 5/06; B22C 5/08; B22C 5/185

See application file for complete search history.

(56) References Cited

U.S. PATENT DOCUMENTS

| | | | | |
|---|---|---|---|---|
| 2,480,748 | A * | 8/1949 | Luce | B22C 5/185 209/158 |
| 5,295,821 | A * | 3/1994 | Daukss | B22C 5/18 432/103 |
| 5,540,270 | A | 7/1996 | Grote et al. | |
| 5,816,312 | A * | 10/1998 | Suginaka | B22C 5/185 164/155.1 |
| 2019/0351479 | A1* | 11/2019 | Federhen | B22C 5/06 |

FOREIGN PATENT DOCUMENTS

| | | | | |
|---|---|---|---|---|
| CN | 108 296 430 | | 7/2018 | |
| EP | 3202927 | A1 * | 8/2017 | B22C 5/06 |
| JP | 2016-129897 | | 7/2016 | |
| JP | 6445334 | | 12/2018 | |
| WO | 85/03462 | | 8/1985 | |

OTHER PUBLICATIONS

Extended European Search Report for EP19200156.8 dated Mar. 20, 2020, 7 pages.

Office Action dated Jun. 11, 2021 in corresponding Indian Application No. 202014040425, 5 pages.

* cited by examiner

*Primary Examiner* — Kevin P Kerns
*Assistant Examiner* — Steven S Ha
(74) *Attorney, Agent, or Firm* — Nixon & Vanderhye PC

(57) ABSTRACT

An apparatus and a method for cleaning sand used at a foundry, wherein sand to be cleaned is screened by a screening apparatus. The screened sand and at least one liquid mixture is fed into an abrasive apparatus. After that, the screened sand is rubbed by the abrasive apparatus. The rubbed sand and at least one liquid mixture is added to a water separation screen for separating a water blend from the rubbed sand. Finally, the separated sand is transferred into an oven and cleaned thermally by rotating the separated sand in the heated oven.

22 Claims, 2 Drawing Sheets

CLEANING SAND USED AT FOUNDRY

This application claims priority to EP Patent Application No. 19200156.8 filed Sep. 27, 2019, the entire contents of which are hereby incorporated by reference.

BACKGROUND OF THE INVENTION

The invention relates to a method and an apparatus for cleaning sand used at a foundry.

In prior art methods, the sand to be cleaned is thermally cleaned by rotating the sand in a large, slightly inclined oven. Before cleaning, the sand may be pre-processed by crushing any lumps and cleaning the sand fraction by magnetic separation. In thermal cleaning, mechanically pre-processed sand and hot air is fed to a rotating oven. Finally, the cleaned sand is let run from the second end of the oven. In addition, a binder-removing additive may be added to pre-processed sand after magnetic separation to improve the cleaning of certain impurities in thermal recovery.

When the sand is thermally cleaned by rotating the sand in a large oven, a shell comprising a binder, such as resin and hardener, remains around a sand grain. Thermal cleaning works well, if the thermally cleaned sand does not need to be completely clean and binders around the sand grains are allowed. This kind of thermally cleaned sand has a high pH and electrical conductivity. The high pH may cause the sand to lump up or even glaze. However, if high purity sand, so-called foundry sand is needed, it is necessary to add a binder-removing additive, like kaolin, to the sand after magnetic separation to improve removal of binders during thermal recovery and to reduce the electrical conductivity. Use of the binder-removing additive is expensive, which significantly increases the cost of purified sand. In addition, the use of the binder-removing additive is not suitable for all sand types.

BRIEF DESCRIPTION OF THE INVENTION

An object of the invention is thus to develop a new method and an apparatus for cleaning sand used at a foundry. The objects of the invention are achieved by a method and an apparatus, which are characterized by what is stated in the independent claims. Some preferred embodiments of the invention are disclosed in the dependent claims.

The invention is based on the idea of providing a new kind of method and an apparatus for removing binder around a sand grain to produce high-purified sand.

An advantage of a method and an apparatus of the invention is that high purity sand, so-called foundry sand, can be produced without expensive binder removing additives, thereby making the manufacturing process less expensive. In the solution according to the invention, the sand is pre-treated mechanically using so-called water shearing where the sand is mechanically rubbed in a mechanical abrasion before thermal regeneration and/or cleaning. This kind of pre-treatment lowers a pH and an electrical conductivity of the sand. This has the effect that the pH neutral sand may be used in all binder systems at the foundries. The electrical conductivity tells how much of the binder system salts remain in the sand, thus, the lower the electrical conductivity the cleaner the sand is. When sand grains are rubbed against each other, binder is released from the surface of the sand grains and salts of the binder dissolve into water. After pre-treatment, the purified sand is subjected to thermal recovery and/or purification to remove remaining organic materials. The heat recovered may be used to pre-heat the sand, or as a heat source of a property. By means of dust removal and screening, the sand also becomes cleaner and of a more uniform quality. Mechanical pre-treatment speeds up thermal recovery because the amount of the binder to be burned is significantly lower, thus there is no need to use the binder-removing additive in pre-treatment.

BRIEF DESCRIPTION OF THE DRAWING

The invention is now described in greater detail in connection with the preferred embodiments and with reference to the attached drawings, in which.

DETAILED DESCRIPTION OF THE INVENTION

Figure 1:
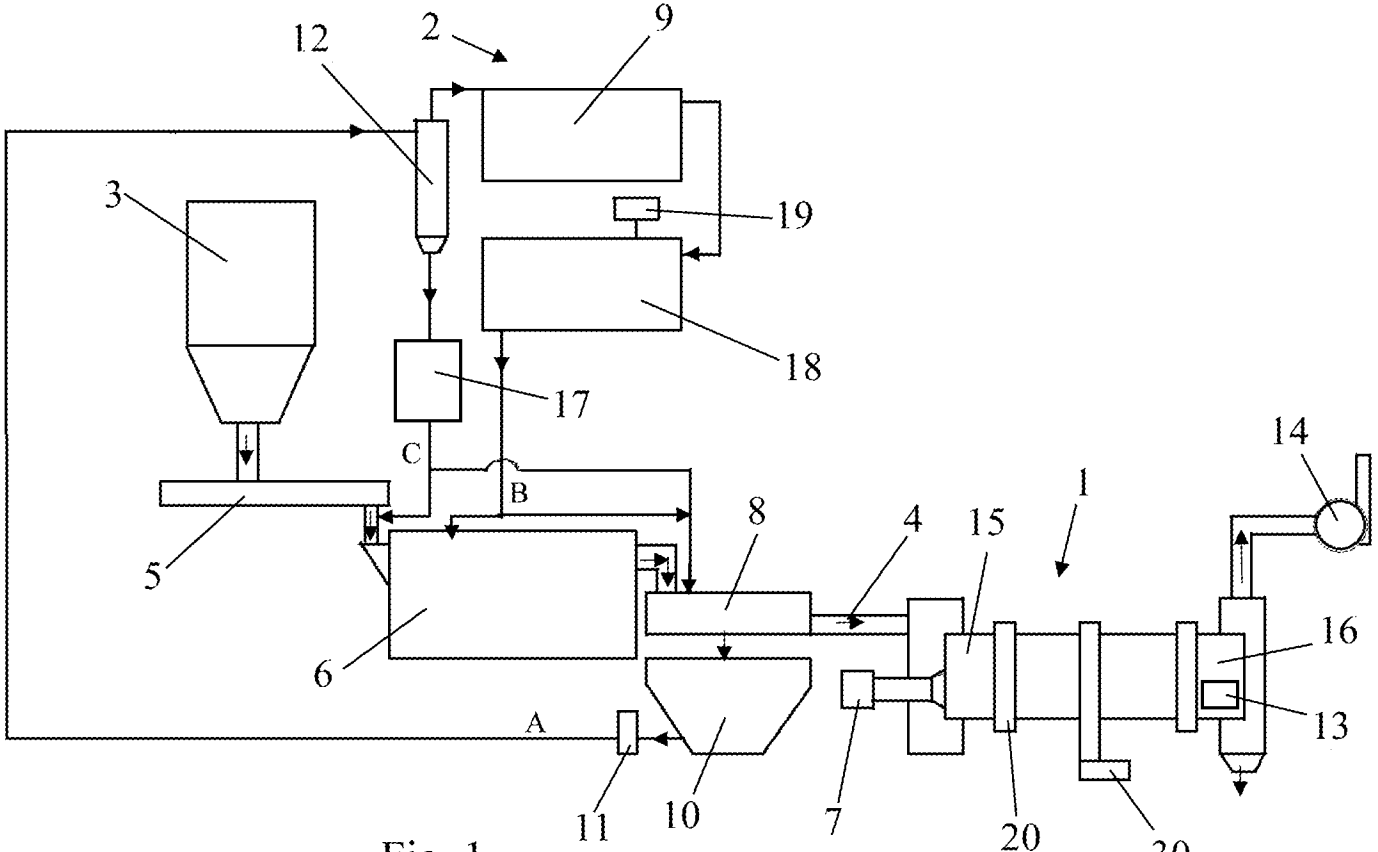
FIG. 1 shows an apparatus according to an embodiment for cleaning sand used at a foundry.

FIG. 1 shows an apparatus according to an embodiment for cleaning sand used at a foundry. The apparatus may comprise a screening apparatus 5, an abrasive apparatus 6, a water separation screen 8, and an oven 1. The apparatus may be arranged to screen 22 sand to be cleaned by the screening apparatus 5. After that, the screened sand and at least one liquid mixture may be feed 23 into the abrasive apparatus 6 to be rubbed 24 by the abrasive apparatus 6. The sand to be cleaned is treated by water shearing by manually rubbing sand grains against each other together with at least one liquid mixture in the abrasive apparatus 6. With this treatment, binders around the sand grains are removed making the sand easier and faster to clean further. The at least one liquid mixture may comprise at least one of the following: water, water and an additive, a water mixture, an aqueous mixture, and an aqueous mixture without particles like chromite. The rubbed sand and at least one liquid mixture may be added 25 to the water separation screen 8 to separate 26 a water blend A from the rubbed sand. The separated sand may be transferred 27 into the oven 1 and cleaned 28 thermally by rotating the separated sand in the heated oven 1 by rotating the oven 1. The rubbed sand is cleaner because it does not comprise so many binders, thus, thermal cleaning at the oven 1 needs less time and is also much cheaper.

Referring further to the embodiment according to FIG. 1, a lumpy sand to be cleaned may first pass through pre-processing to a dosing feeder 3. In pre-processing, any lumps of the sand may be crushed. The dosing feeder 3 may feed the sand to be cleaned to a screening apparatus 5 for screening 22 sand to be cleaned. The screening apparatus may be a rotary screen. Screening is done with a screening mesh, wherein mesh size may be between 5-50 mm, advantageously 10-20, the most advantageously 10 mm. From screening, the sand grains smaller than or equal to a screening limit may be led into water shearing for rubbing 24 the screened sand in a mechanical abrasion by an abrasive apparatus 6. The screening limit may be preferably 10 mm. The sand grains larger than the screening limit may be returned to pre-processing for re-crushing. After that, the screened sand comprising the sand grains smaller than or equal to a screening limit and at least one liquid mixture may be fed 23 into the abrasive apparatus 6 for water shearing. Water shearing may be carried out with an abrasive apparatus 6, to which the at least one liquid mixture may be added. The at least one liquid mixture is added because the moisture content of the sand coming from the screening apparatus 5 is generally only 5%, which is not enough to process water shearing properly. A liquid-sand mixture in water shearing may preferably contain sand and the at least one liquid mixture, wherein the amount of the at least one liquid mixture may be 10-70%, more preferably 20-40%, and the most preferably 20-30%. If necessary, a pH adjusting agent may be added to the at least one liquid mixture, but its use is not mandatory. Water shearing may be carried out with either a vertical or a horizontal abrasive apparatus 6. The horizontal abrasive apparatus 6 may comprise two horizontal axes with blades attached to recycle the sand-liquid mixture in a reservoir of the abrasive apparatus 6. The vertical abrasive apparatus 6 may comprise a single vertical axis to which blades are attached. With the abrasive apparatus 6, the sand grains may be mechanically rubbed against each other, whereby a binder shell around the sand grains may broke and the binder may be released from the surface of the sand grains and dissolved in water. This has the effect that the thermal cleaning is faster and there is no need to use a binder-removing additive.

After abrasion, the rubbed sand and at least one liquid mixture may be added 25 to a water separation screen 8 for washing the rubbed sand. The water separation screen 8 may separate 26 a water blend A from the rubbed sand-liquid mixture to dry the rubbed sand and to remove impurities. The water separator screen 8 may comprise a mesh, through which the water blend may fall into the water reservoir 10 underneath the water separator screen 8 for further treatment. The size of the mesh may be between 0.1-0.5 mm, advantageously 0.1-0.3 mm, the most advantageously 0.3 mm. The water blend A may comprise at least water, sand particles, binders, and dust. From the water separator screen 8, the rubbed and washed sand may be transferred 27 by a conveyor 4 to the oven 1, wherein the separated sand may be cleaned 28 thermally by rotating the separated sand in the heated oven 1 by rotating the oven 1.

According to an embodiment, the water blend A from the water separation screen 8 may be fed to a fine separation process 2 by using a pump 11. The fine separation process 2 may be used for forming a water mixture B and an aqueous mixture C. The water mixture B from the fine separation process 2 may be added into the abrasive apparatus 6 and to the water separation screen 8, and the aqueous mixture C may be added into the abrasive apparatus 6 and/or to the water separation screen 8. An apparatus may comprise a control unit, which may take care of water dispensing.

According to an embodiment, fine separation process 2 may further comprise feeding the water blend A from the water separation screen 8 to a filtering unit 12 for separating sand particles and the aqueous mixture C from the water blend A. According to an embodiment, the filtering unit 12 may comprise a cyclone for separating the sand particles and the aqueous mixture C. In the filtering unit 12, the sand particles and the aqueous mixture C may be separated and the separated sand particles equal to or below the first separation limit may be fed from the filtering unit 12 into a sand treatment apparatus 9 for further separating sand particles. According to the embodiment, the first separation limit may preferably be equal to or below 20-100 μm, and more preferably equal to or below 75 μm. The sand particles above the first separation limit may form the aqueous mixture C. According to an embodiment, the sand particles larger than the first separation limit, for example >75 μm, may form the aqueous mixture C, and the finer sand particles, smaller than or equal to the first separation limit, for example ≤75 μm may be fed into the sand treatment apparatus 9, which may also comprise a cyclone.

From the sand treatment apparatus 9, the further separated sand particles equal to or below the second separation limit may be fed into a water tank 18 for forming a water mixture B to be added into the abrasive apparatus 6 and to the water separation screen 8. The water tank 18 may comprise water. According to the embodiment, the second separation limit may preferably be equal to or below 20-100 μm, more preferably equal to or below 20-75 μm, and the most preferably equal to or below 20 μm. In an embodiment, the sand particles larger than the second separation limit, for example >20 μm, are discharged from the process for further processing, and the finer sand particles smaller than or equal to the second separation limit, for example ≤20 μm may be fed into the water tank 18.

According to an embodiment, an additive from a container 19 may be added into the water tank 18, for adjusting a pH of the water mixture B in the water tank 18. This way the pH of the sand may be lowered, so that it fits to all binder systems at foundries. The pH of the water mixture in the water tank 18 may be adjusted by taking into account a pH of the sand to be cleaned and the pH of the water mixture B in the water tank 18. Sensors may be used to measure the pH in the sand and in the water tank 18. The pH of the water mixture B may be adjusted using an additive suitable for adjust pH. The additive may comprise at least one of the following: salt and sulphuric acid. Adjusting the pH is not mandatory, but may be done because the sand to be cleaned is usually alkaline, which requires acid to neutralize the sand. The pH may be adjusted automatically with the help of a control unit. The water mixture B in the water tank 18 may comprise binder residues and water. It may also comprise the additive. The water mixture B is led into the abrasive apparatus 6 and to the water separation screen 8.

According to an embodiment, in the fine separation process 2 the water blend A from the water separation screen 8 may be fed to a filtering unit 12 for separating an aqueous mixture C and the sand from the water blend. The aqueous mixture C from the filtering unit 12 may then be fed into the abrasive apparatus 6 and/or to the water separation screen 8. According to an embodiment, when the abrasive apparatus 6 is horizontal, the aqueous mixture C may be led both into the abrasive apparatus 6 and to the water-separating screen 8. In another embodiment, when the abrasive apparatus 6 is vertical, the aqueous mixture C may be led both into the abrasive apparatus 6 and to the water-separating screen 8. In another embodiment, when the abrasive apparatus 6 is vertical, the aqueous mixture C may be led to the water-separating screen 8 only. According to an embodiment, the aqueous mixture C may be fed from the filtering unit 12 into a gravity separator 17 where particles from the aqueous mixture C may be separated. The separated particles may be led to the further processing and the aqueous mixture without separated particles may be added into the abrasive apparatus 6 and/or to the water separation screen 8. According to an embodiment, the gravity separator 17 may remove particles, wherein the separated particles are at least chromite particles. The separator may separate the particles by weight. According to an embodiment, the separator may separate materials that are heavier or lighter than the sand. According to an embodiment, the aqueous mixture C may or may not comprise separated particles. The chromite particles oxidizes during the thermal cleaning, thus impairing the entire thermal cleaning. Separation of the chromite particles in the pre-treatment process allows better chromite re-use.

After water shearing, the sand to be cleaned may be fed into the oven 1 for cleaning at a first end 15 of the oven. Heat energy produced by a heat source 7 is fed to the oven 1. It is essential that the sand moving into the oven can be heated up fast. The sand may be preheated external to the oven 1. The sand may be fed in the oven 1 at the first end 15 of the oven 1. Alternatively, the sand being moved to the oven 1 may be preheated within the oven 1 in a feed pipe, for example, which feed pipe enters the oven 1 advantageously at the centre region of the oven 1 or the second end 16, and the sand moves from the feed pipe to the oven to be cleaned advantageously at the first end 15 of the oven. Heat energy may be fed to the oven 1 along a heat recovery system as best seen fit at each site. A liquid gas burner, for example, may act as the heat source 7. The oven 1 is in a thermal insulation material to reduce thermal loss. Thermal loss may be recovered and used, for example, for preheating the sand to be cleaned, or as a heat source of one or more properties. The oven 1 is substantially supported by supports 20. There are means advantageously arranged to the supports 20 for adjusting the inclination of the oven. The inclination adjustment arrangement may also have been implemented in another manner, to tilt the entire apparatus, for example. The most suitable solutions for adjusting the inclination of the oven 1 may be adapted on a case-by-case basis. The most essential thing is that is possible to adjust the inclination of the rotating oven 1. In addition, the apparatus has means 30 to rotate the oven 1 and to adjust the rotating speed.

Flue gasses may be removed from the second end 16 of the oven 1, with which some of the dust that the sand has brought with it is removed. However, because of the pretreatment there is not much dust left to be removed. With the flue gasses, impurities removed from the sand may also be discharged. The flue gasses may be processed with appropriate filter arrangements 14 and cooled down to recover heat. The temperature of the oven may be measured at the second end 16 of the oven 1 with one of more temperature sensors 13, and thermally recovered or cleaned sand may be let run out of the oven 1.

The thermally recovered or cleaned sand may be let directly run from the oven 1, for example, to a collector, container, road tanker, pick up, sampling vessel, something else suitable for the purpose in question, or to any of the aforementioned through a conveyor or enclosed conveyor. If the sand is let run to an enclosed conveyor, in the enclosed conveyor more dust may be removed from the sand, and the sand may be transferred by the conveyor or another suitable carrier of transfer means further away from the oven 1 either to be stored in appropriate containers or transport equipment to be delivered further to foundry use of another suitable use.

One or more actuators of the apparatus may be controlled by means of a control unit. The control unit also monitors the values of the detectors and sensors in the apparatus, and utilizes the information when controlling the actuators. The control unit may also be provided with different kind of starting data, initial data. The control unit is part of a control room hooked up in connection with the apparatus, from which the operation of the apparatus may be managed by means of user interface of different kind. Control room solutions of different kind are known per se, so for that reason they are not described in closer detail in this context.

The measured and initial data of the sand to the cleaned are fed to the control unit. The control unit notes these when it determines the most suitable parameters for the different actuators in order to thermally recover or clean the batch of sand coming in to be processed at each particular time. As initial data may be given, among other things, the previous use of the sand, storage location or locations of the sand after the previous use, humidity content of the sand mass, pH concentration of sand or water mixture in the water tank 18, electrical conductivity of the sand, and/or the temperature of the sand as measured by one or more sensors placed in the dosing feeder 3, for example. Previous use indicates what impurities there might be in the sand due to the previous use. The storage locations indicate what might have happened to the sand between the previous use and the cleaning carried out. The temperature before cleaning in turn helps the control unit determine the sand temperature throughout water shearing, thermal recovery, or cleaning. It is also important to measure parameters of the rubbed sand after water shearing, like its humidity content of the sand mass, pH concentration, electrical conductivity, and/or the temperature of the sand as measured by one or more sensors. Sensors may also be used to measure a pH content of the water mixture in the water tank 18. The dosage of an additive is affected by the initial data measured and obtained from the sand to be cleaned and the pH content of the water mixture B in the water tank 18.

When foundry sand is cleaned, there must be enough air space for the discharge of impurities. The impurities are removed with the flue gasses, so the amount of sand in the oven 1 must be kept sufficiently low. In other words, the sand to air mixture ratio must also be monitored. The larger the amount of sand in the oven 1 is the worse can the impurities from among the sand exit with the flue gasses. When determining the amount of sand and the rotating speed of the oven 1, it is also essential that the sand mass must not just flow along the bottom of the oven 1, which means that the rotating speed is too low in relation to the amount of sand being cleaned. If the rotating speed of the oven 1 is too high, the sand rotates on the circumference of the oven 1 with the oven 1. With a suitable rotating speed in relation to the sand mass being cleaned, the sand rises on the edging of the oven 1 up to such an extent that at some stage the sand mass detaches from the edge of the oven 1 and at least partly falls in the air. In such a case, the sand mass recovers thermally or cleans more evenly, because cleaning hot air is better mixed with the sand mass, that is, the sand being cleaned is better aerated and the impurities may better exit with the air.

The cleaned sand may be let run onto a conveyor, in a collecting receptacle, transport tank, dust removal or another place suitable for the purpose in question, such as heat recovery preceding transport or storage. Heat recovery may still be carried out from cleaned sand waiting for transportation or from stored sand.

According to an embodiment, the control unit uses the information it has received concerning each time instant on the oven 1 temperature at any one time, amount of sand fed in the oven 1, advancing speed of the sand, temperature of the sand to be cleaned as it is being fed into the oven 1, temperature of exiting sand, amount of heat energy fed in, heat losses in different parts of the apparatus, and temperature of exiting flue gasses as well as other possible measured values as return data to perform future controls and adjustments.

Therefore, the control unit can, by means of the return data, make corrective adjustment actions, for example, in the control room to reach the target settings given to the control unit. From the control room, it is possible to determine, for example, target values for the average temperature of the sand, target values for the average pH and/or electrical conductivity of the sand, the cleaned sand that is let run, exiting flue gasses, or any combination of the above. It is also possible to set a target for the advancing speed of the sand, and by monitoring the realized values obtained as the return data the control unit is able to determine whether the target was realized and carry out required changes, if the realization calculated according to the return data does not correspond with the target.

According to an embodiment, the apparatus is adapted to cool down the cleaned sand and to recover heat from it, and/or to remove dust from the cleaned sand. The sand thermally recovered or cleaned according to the above methods may additionally, after the processing, be let run from the oven 1 on a screw conveyor to cool down the hot sand and to recover heat. The flue gasses may also be also processed. With the flue gasses, part of the dust that the sand brought with it and impurities removed from the sand may also be discharged. The flue gasses may be processed with appropriate filter arrangements 14 and cooled down to recover heat. According to an embodiment, the apparatus may be adapted to remove flue gasses from the oven 1 and to cool down the flue gasses to recover heat.

According to an embodiment, an apparatus may comprise a screw conveyor to cool down sand and to recover heat, and/or a screen part to remove dust and lumps. The cooled down sand from the screw conveyor may be passed onto the screen part, which may comprise at least one mesh. The screen part may also comprise a watering system at the top part of the enclosure over at least one mesh, used to water the sand on the at least one mesh, whereby the sand is cleaned and at the same time also cooled down more. The sand from the screen part may be stored or transported to a usage site.

According to an embodiment, thermally recovered or cleaned sand may after the processing be let run from the oven 1 to the screw conveyor to cool down the hot sand and to recover heat. The heat recovered from the screw conveyor may be used to preheat the sand, and/or as a heat source of one or more properties. According to an embodiment, the screen part may also be used for dust and lump removal, after which the sand is stored or transported to a usage site.

According to an embodiment, the control unit may be used to adjust the various features of the apparatuses, such as the inclination of the screw conveyor and the flow of the liquid thereon, to adjust the inclination of the screen part and the suction devices and watering system it has, to adjust the pH of the water mixture, as well as to adjust the heat directed to preheating of sand.

According to an embodiment, the apparatus may further comprise at least one sensor, a control unit for monitoring data conveyed by one of more sensors in the apparatus and for controlling one or more actuators by utilizing the monitored data conveyed by the aforementioned one or more sensors.

According to an embodiment, flue gasses may be removed from the oven 1, with which some of the dust that the sand has brought with it is removed. With the flue gasses, impurities removed from the sand may also be discharged. Flue gasses may be led to sand preheating and from there to cyclone cleaning. In sand preheating, the heat that was present in the flue gasses is led to the sand, whereby the flue gasses cool down. If it is not desired to employ sand pre-heating, the flue gasses may be separately cooled down to recover heat and/or directly led to the cyclone. According to an embodiment, the apparatus may be adapted to remove flue gasses from the second end of the oven 1 and to cool down the flue gasses to recover heat. By means of the cyclone, the flue gasses may be brought to a rotating motion whereby dust and other impurities accumulated from the san are gathered at the bottom of the cyclone, from where they can be removed. In cyclone cleaning the remaining flue gasses may be led on to dust removal, where the flue gasses may be processed with appropriate filter arrangements, if need be. According to an embodiment, the apparatus is adapted to use the heat recovered from the screw conveyor and flue gasses to preheat the sand and/or as the heat source of one or more properties.

Figure 2:
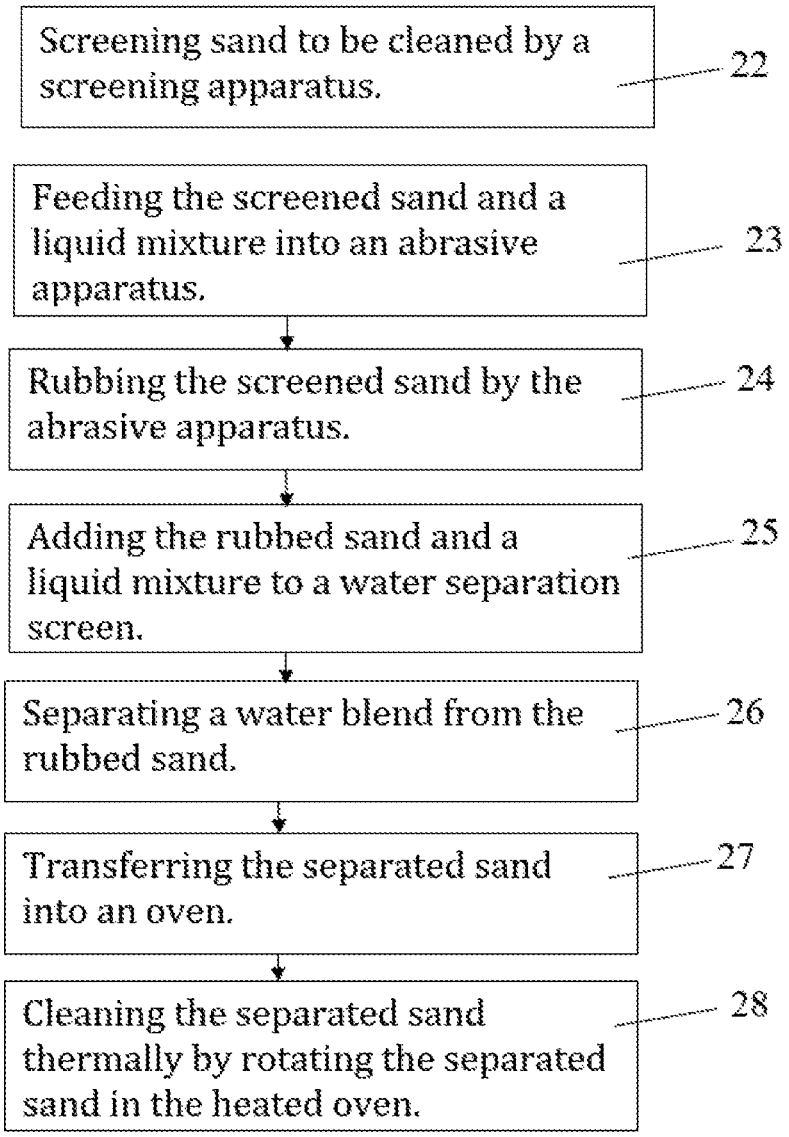
FIG. 2 shows a method for cleaning sand used at a foundry.

FIG. 2 illustrates a method for cleaning sand used at a foundry, wherein screening 22 sand to be cleaned by a screening apparatus 5 and feeding 23 the screened sand and at least one liquid mixture into an abrasive apparatus 6. After that, the screened sand may be rubbed 24 by the abrasive apparatus 6. Thereafter, the rubbed sand and at least one liquid mixture may be added 25 to a water separation screen 8 for separating 26 a water blend C from the rubbed sand. Finally, the separated sand may be transferred 27 into an oven 1 and cleaned 28 the separated sand thermally by rotating the separated sand in the heated oven 1.

An embodiment comprises a computer program product, which comprises computer program code means stored on a computer-readable media, which computer code means may be arranged to execute the steps of any method defined in any process above and using any apparatus mentioned above when said computer program is executed in a computer.

An embodiment comprises s computer-readable media on which is stored a computer program product, which computer program comprises computer program code means that cause the computer to execute the steps of the any method defined above using any apparatus mentioned above when said computer program is executed in a computer.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. A method for cleaning sand used at a foundry, the method comprising:

screening sand to be cleaned by a screening apparatus;

feeding the screened sand and at least one first liquid mixture into an abrasive apparatus;

rubbing the screened sand by the abrasive apparatus;

adding the rubbed sand and at least one second liquid mixture to a water separation screen;

separating a water blend from the rubbed sand;

feeding the water blend from the water separation screen to a fine separation process for forming a water mixture and an aqueous mixture;

adding the water mixture from the fine separation process into the abrasive apparatus and to the water separation screen;

adding the aqueous mixture into the abrasive apparatus and/or to the water separation screen;

transferring the separated sand into an oven; and cleaning the separated sand thermally by rotating the separated sand in the heated oven.

2. A method as claimed in claim 1, wherein the at least one second liquid mixture comprises at least one of the following: water, water with an additive, the water mixture, and the aqueous mixture.

3. A method as claimed in claim 1, wherein the fine separation process further comprises:

feeding the water blend from the water separation screen to a filtering unit for separating sand particles and the aqueous mixture from the water blend;

feeding the separated sand particles equal to or below a first separation limit from the filtering unit into a sand treatment apparatus for further separating sand particles; and feeding sand particles equal to or below a second separation limit from the sand treatment apparatus into a water tank for forming water mixture to be added into the abrasive apparatus and to the water separation screen.

4. A method as claimed in claim 3, wherein separated sand particle size for the first separation limit is equal to or below 20-100 μm, and the second separation limit is equal to or below 20-100 μm.

5. A method as claimed in claim 3, further comprising:

adding an additive into the water tank from a container for adjusting a pH of the water mixture in the water tank.

6. A method as claimed in claim 5, wherein a pH of the water mixture in the water tank is adjusted by taking into account a pH of the sand to be cleaned and the pH of the water mixture in the water tank.

7. A method as claimed in claim 3, wherein separated sand particle size for the first separation limit is equal to or below 75 μm; and the second separation limit is equal to or below 20-75 μm, and the most preferably equal to or below 20 μm.

8. A method as claimed in claim 7, wherein separated sand particle size for the second separation limit is equal to or below 20 μm.

9. A method as claimed in claim 1, wherein the fine separation process further comprises:

feeding the water blend from the water separation screen to a filtering unit for separating sand particles and the aqueous mixture from the water blend; and feeding the aqueous mixture from the filtering unit into the abrasive apparatus and/or to the water separation screen.

10. A method as claimed in claim 9, wherein the fine separation process further comprises:

feeding the aqueous mixture from the filtering unit into a gravity separator; and separating particles from the aqueous mixture by the gravity separator and adding the separated aqueous mixture into the abrasive apparatus and/or to the water separation screen.

11. A non-transitory computer-readable medium on which is stored computer program code executable to perform the method defined in claim 1.

12. A method as claimed in claim 1, wherein the at least one first liquid mixture and the at least one second liquid mixture include the same material.

13. A method as claimed in claim 1, wherein the at least one first liquid mixture and the at least one second liquid mixture include different material.

14. An apparatus for cleaning sand used at a foundry, the apparatus comprising:

a screening apparatus, an abrasive apparatus, a water separation screen, an oven;

wherein the apparatus is configured to:

screen sand to be cleaned by the screening apparatus;

feed the screened sand and at least one first liquid mixture into the abrasive apparatus;

rub the screened sand by the abrasive apparatus;

add the rubbed sand and at least one second liquid mixture to the water separation screen;

separate a water blend from the rubbed sand;

feed the water blend from the water separation screen to a fine separation process for forming a water mixture and an aqueous mixture;

add the water mixture from the fine separation process into the abrasive apparatus and to the water separation screen;

add the aqueous mixture into the abrasive apparatus and/or to the water separation screen;

transfer the separated sand into the oven; and clean the separated sand thermally by rotating the separated sand in the heated oven.

15. An apparatus as claimed in claim 14, further comprising one or more sensors, a control unit configured to monitor data conveyed by at least one of the one or more sensors and to control one or more actuators by utilizing the monitored data conveyed by the one or more sensors.

16. An apparatus as claimed in claim 14, the apparatus being further configured to cool down the cleaned sand and to recover heat from it, and/or to remove dust from the cleaned sand.

17. An apparatus as claimed in claim 14, the apparatus being further configured to remove flue gasses from the oven and to cool down the flue gasses to recover heat.

18. An apparatus as claimed in claim 14, wherein the fine separation process further comprises:

feeding the water blend from the water separation screen to a filtering unit for separating sand particles and the aqueous mixture from the water blend;

feeding the separated sand particles equal to or below a first separation limit from the filtering unit into a sand treatment apparatus for further separating sand particles; and feeding sand particles equal to or below a second separation limit from the sand treatment apparatus into a water tank for forming water mixture to be added into the abrasive apparatus and to the water separation screen.

19. An apparatus as claimed in claim 18, wherein an additive is added into the water tank from a container for adjusting a pH of the water mixture in the water tank.

20. An apparatus as claimed in claim 19, wherein a pH of the water mixture in the water tank is adjusted by taking into account a pH of the sand to be cleaned and the pH of the water mixture in the water tank.

21. An apparatus as claimed in claim 14, wherein the fine separation process further comprises:

feeding the water blend from the water separation screen to a filtering unit for separating sand particles and the aqueous mixture from the water blend; and feeding the aqueous mixture from the filtering unit into the abrasive apparatus and/or to the water separation screen.

22. A non-transitory computer program product that comprises computer program code stored on a computer-readable medium, the computer code being executable to perform operations using an apparatus for cleaning sand used at a foundry, the apparatus comprising a screening apparatus, an abrasive apparatus, a water separation screen, and an oven; wherein the operations are configured to control the apparatus to at least:

screen sand to be cleaned by the screening apparatus;

feed the screened sand and at least one first liquid mixture into the abrasive apparatus;

rub the screened sand by the abrasive apparatus;

add the rubbed sand and at least one liquid mixture to the water separation screen;

separate a water blend from the rubbed sand;

feed the water blend from the water separation screen to a fine separation process for forming a water mixture and an aqueous mixture;

add the water mixture from the fine separation process into the abrasive apparatus and to the water separation screen, add the aqueous mixture into the abrasive apparatus and/or to the water separation screen;

transfer the separated sand into the oven; and clean the separated sand thermally by rotating the separated sand in the heated oven when said computer program code is executed in a computer.

* * * * *